US009875697B2

(12) United States Patent
Kang et al.

(10) Patent No.: US 9,875,697 B2
(45) Date of Patent: Jan. 23, 2018

(54) PARALLEL CONSTANT CURRENT LED DRIVING UNITS FOR DRIVING A LED STRING AND METHOD OF PERFORMING THE SAME

(75) Inventors: Tae-kyoung Kang, Cheongju-si (KR); Su-jin Lee, Cheongju-si (KR); Gyu-ho Lim, Cheongju-si (KR)

(73) Assignee: Magnachip Semiconductor, Ltd., Cheongju-si (KR)

( * ) Notice: Subject to any disclaimer, the term of this patent is extended or adjusted under 35 U.S.C. 154(b) by 177 days.

(21) Appl. No.: 13/586,296

(22) Filed: Aug. 15, 2012

(65) Prior Publication Data

US 2013/0050289 A1 Feb. 28, 2013

(30) Foreign Application Priority Data

Aug. 30, 2011 (KR) ..... 10-2011-0087460
May 21, 2012 (KR) ..... 10-2012-0053859

(51) Int. Cl.
*G09G 3/34* (2006.01)
*H05B 33/08* (2006.01)

(52) U.S. Cl.
CPC ..... *G09G 3/342* (2013.01); *H05B 33/0815* (2013.01); *G09G 2320/064* (2013.01)

(58) Field of Classification Search
CPC ..... H05B 33/0827; H05B 33/0818
USPC ..... 315/291; 323/271; 345/102, 212, 690
See application file for complete search history.

(56) References Cited

U.S. PATENT DOCUMENTS

2004/0080301 A1 4/2004 Burgyan et al.
2009/0109165 A1* 4/2009 Park et al. ..... 345/102
2010/0148681 A1* 6/2010 Kuo ..... H05B 33/0818 315/193
2010/0177127 A1* 7/2010 Akiyama et al. ..... 345/690
2010/0283773 A1 11/2010 Kim
2011/0140615 A1* 6/2011 Min et al. ..... 315/185 R
2012/0206054 A1 8/2012 Kim

FOREIGN PATENT DOCUMENTS

TW 201106792 A1 2/2011
TW 201125425 A1 7/2011

OTHER PUBLICATIONS

Taiwanese Office Action dated May 30, 2016 in counterpart Taiwanese Application No. 101131248. (6 pages in Taiwanese).

* cited by examiner

*Primary Examiner* — Sepehr Azari
(74) *Attorney, Agent, or Firm* — NSIP Law

(57) ABSTRACT

A Light Emitting Diode (LED) driver apparatus and a method of driving an LED array are provided. A Light Emitting Diode (LED) driver apparatus includes: a DC-DC converter configured to supply a driving voltage to an LED array, a plurality of LED drivers configured to drive the LED array according to a dimming signal, in which the plurality of LED drivers are connected to one another in parallel to supply currents to the LED array.

18 Claims, 4 Drawing Sheets

PARALLEL CONSTANT CURRENT LED DRIVING UNITS FOR DRIVING A LED STRING AND METHOD OF PERFORMING THE SAME

CROSS-REFERENCE TO RELATED APPLICATION(S)

This application claims the benefit under 35 U.S.C. §119 (a) from Korean Patent Application No. 10-2011-0087460, filed on Aug. 30, 2011, and No. 10-2012-0053859, filed on May 21, 2012, in the Korean Intellectual Property Office, the entire disclosures of which are incorporated herein by reference for all purposes.

BACKGROUND

1. Field

The following description relates to a Light Emitting Diode (LED) driver apparatus, and to, for example, an LED driver apparatus that can supply a stable constant current to an LED array by using a plurality of constant current sources.

2. Description of Related Art

Liquid Crystal Displays (LCDs) are widely used because they are relatively thinner and light-weight in comparison to many other types of display apparatuses and exhibit lower driving voltage and consumes less power. However, the liquid crystal used in an LCD is a non-emitting substance that does not emit light by itself. Thus, an LCD requires an additional backlight for supplying light to its liquid crystal panel.

A Cold Cathode Fluorescent Lamp (CCFL), a Light Emitting Diode (LED), and the like, are often used as a backlight source of an LCD. However, CCFLs use mercury and thus may cause environmental pollution. Also, CCFLs exhibit a slow response speed and a low color representation. Thus, CCFLs are inappropriate for making an LCD that is light-weight, thin, short, and/or small in size.

LEDs do not use harmful materials such as mercury and are thus environment-friendly. In addition, LEDs allow impulse driving. Also, a light source made with LEDs exhibits a high color representation, with the ability to independently adjust the amount of light emitted from red (R), green (G), and blue (B) diodes to change the luminance, the color temperature, and the like of the obtained image. Thus, LEDs are appropriate for making an LCD that is light-weight, thin, short, and/or small in size. Therefore, LEDs have been widely used as a backlight source of LCDs and other display devices.

In an LCD backlight unit using LEDs that are connected to one another in series, such as a backlight unit that uses LED arrays, a DC-DC converter is often used to adjust a power source supplied to the LEDs, and a driving circuit that functions as a constant current source is often used to supply a constant current to the LEDs.

In order to maintain uniform brightness and color in a backlight, the LEDs are often driven by using the same current regardless of voltages of the LEDs. For example, a single constant current source may be provided under an LED array to supply the same constant current to the LED array.

However, in order to supply a large constant current with an increase in a required amount of an LED current, a constant current source is typically implemented with a transistor. When a constant current source that supplies a large constant current is implemented with a transistor, a parasitic capacitance component of the transistor may become very large. This may reduce the stability of the current and/or lengthen the settlement time of the constant current. In such a current source, a large capacitance may be required to compensate for the parasitic capacitance component, and to, for instance, maintain the stability of the system. In such a case, the settlement time of the constant current source may lengthen, slowing down the time required to achieve a steady current.

SUMMARY

In one general aspect, there is provided a Light Emitting Diode (LED) driver apparatus including: a DC-DC converter configured to supply a driving voltage to an LED array, a plurality of LED drivers configured to drive the LED array according to a dimming signal, in which the plurality of LED drivers are connected to one another in parallel to supply currents to the LED array.

The general aspect of LED driver apparatus may further include an input unit configured to receive the dimming signal from an external device.

The LED drivers may be configured to supply the currents having the same amplitude to the LED array.

The LED drivers may be configured to supply the currents having different amplitudes to the LED array.

In the general aspect of LED driver apparatus, each of the LED drivers may include: a resistor having a first end that is grounded, a switching unit configured to selectively connect an end of the LED array to a second end of the resistor, and a comparator configured to compare a preset reference voltage with a voltage of a common node that connects to both the switching unit and the resistor.

In the general aspect of the LED driver apparatus, the switching unit may be a Field-Effect Transistor (FET) that comprises a drain connected to an end of the LED array, a source may be connected to the common node, and a gate may be connected to an output node of the comparator.

In the general aspect of the LED driver apparatus, the comparator may be an Operational Amplifier (Op-Amp) that is configured to receive the reference voltage through a positive terminal, to receive the voltage of the common node through a negative terminal, and to output a difference between the reference voltage and the voltage of the common node to the gate of the FET.

The comparator may be configured to operate according to the dimming signal.

The general aspect of the LED driver apparatus may further include: a controller configured to control an operation of the plurality of LED drivers according to an amplitude of a current required for the LED array.

The LED array may be driven under a current having an amplitude between 50 mA and 150 mA.

The general aspect of the LED driver apparatus may further include: a Pulse Width Modulation (PWM) signal generator configured to receive the dimming signal and generate a PWM signal, and the DC-DC converter may be configured to provide a forward bias voltage to the LED array based on the generated PWM signal.

In another general aspect, there is provided a Liquid Crystal Display (LCD) including: a liquid crystal panel, and a backlight unit comprising an LED driver apparatus of claim 1.

In yet another general aspect, there is provided a method of driving an LED array involving: supplying a driving voltage to an LED array using a plurality of LED drivers based on a dimming signal, in which the plurality of LED drivers receive the dimming signal from an external device, the plurality of LED drivers are connected to one another in parallel to supply currents to the LED array.

The general aspect of the method may further involve generating a Pulse Width Modulation (PWM) signal based on the dimming signal, and supplying the PWM signal to a DC-DC converter that is configured to provide a forward bias voltage to the LED array.

The LED drivers may be configured to supply the currents having the same amplitude to the LED array.

The general aspect of the method may further involve: controlling an operation of the plurality of LED drivers according to an amplitude of a current required for the LED array as determined according to an external control or an internal calculation.

In the general aspect of the method, each of the LED drivers may include: a resistor having a first end that is grounded, a switching unit configured to selectively connect an end of the LED array to a second end of the resistor, and a comparator configured to compare a preset reference voltage with a voltage of a common node that connects to both the switching unit and the resistor.

Other features and aspects may be apparent from the following detailed description, the drawings, and the claims.

Figure 1:
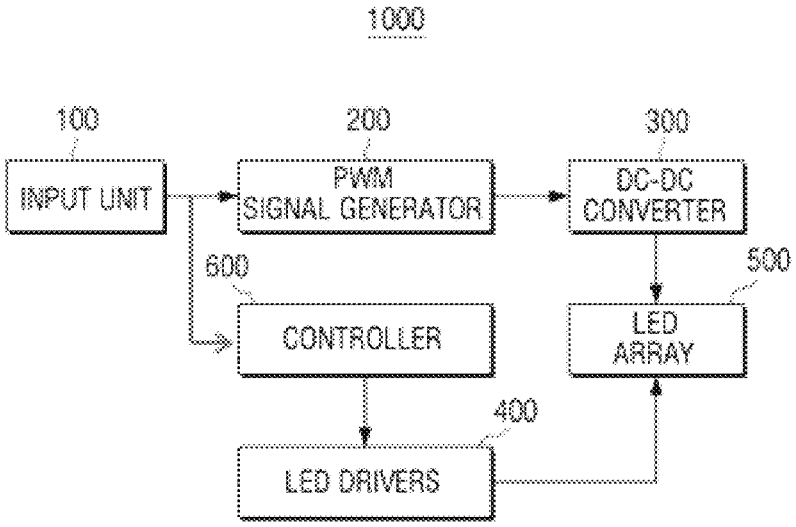
FIG. 1 is a diagram illustrating an example of a Light Emitting Diode (LED) driver apparatus.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

Provided herein are examples of Light Emitting Diode (LED) driver apparatuses and methods of driving an LED array that are capable of supplying a stable current to an LED array and a short settlement time of the current by using a plurality of current sources.

FIG. 1 illustrates an example of a Light Emitting Diode (LED) driver apparatus 1000.

Referring to FIG. 1, the LED driver apparatus 1000 includes an input unit 100, a Pulse Width Modulation (PWM) signal generator 200, a DC-DC converter 300, an LED driver 400, and an LED array 500.

The input unit 100 receives a dimming signal that is used to drive the LED array 500. Examples of digital dimming methods that may be used with an LED include, but are not limited to, a direct mode, a fixed phase mode, and a phase shift mode. A direct mode refers to a method of controlling a frequency and an On-Duty signal through a Packet Assembler/Disassembler (PAD). Also, a fixed phase mode and a phase shift mode refer to methods of generating a PWM frequency in an Integrated Circuit (IC) and receiving only an On-Duty signal through a PAD to control the PWM frequency and the On-Duty signal. A dimming signal refers to a signal that is used to adjust the luminance, color temperature, and the like, of an LED or to compensate for the color temperature of the LED. In the present example, a direct mode in which the dimming signal is received from an external device is described. An external device refers to a device that is outside of the LED driver apparatus 1000. However, other modes, such as the fixed phase mode and the phase shift mode, may be used to obtain the dimming signal in other examples.

The PWM signal generator 200 receives the dimming signal and generates a PWM signal that is used to adjust a power source of the LED array 500. For instance, the PWM signal generator 200 generates the PWM signal that is used to control an amplitude of a driving voltage of the DC-DC converter 300.

The DC-DC converter 300 includes a transistor that performs a switching operation and supplies a driving voltage to the LED array 500 according to the switching operation of the transistor. For instance, the DC-DC converter 300 may convert a DC voltage based on the PWM signal generated by the PWM signal generator 200 and may supply the converted DC voltage, such as the driving voltage, to the LED array 500. For instance, the DC-DC converter 300 may supply a voltage corresponding to a forward bias voltage of the LED array 500 to the LED array 500 so that the LED array 500 operates in a current saturation range.

A plurality of LED drivers 400 drive the LED array 500 according to the dimming signal. For instance, the LED drivers 400 may adjust a driving current of the LED array 500 by using the dimming signal input from the input unit 100. The LED drivers 400 may supply the same constant current or different constant currents to the LED array 500. The structures and operations of the LED drivers 400 are further described later with reference to FIG. 2.

The controller 600 controls operations of the LED drivers 400 according to an amplitude of a constant current required for the LED array 500. For instance, the controller 600 may calculate the amplitude of the constant current required for the LED array 500 according to an external control or an internal calculation and may control all or only a portion of the LED drivers 400 that are appropriate for operating under the calculated amplitude of the constant current.

For example, in the event that each of four LED drivers 400 may supply a constant current of a maximum of 25 mA, and a maximum amplitude of a constant current required for the LED array 500 connected to the four LED drivers is 100 mA, the controller 600 may control all of the four LED drivers 400 to operate. However, in the event that the maximum amplitude of the constant current required for the LED array 500 is 50 mA, the controller 600 may control only two LED drivers 400 to operate.

As described above, the LED driver apparatus 1000 according to the present example supplies a constant current to the LED array 500 by using a plurality of LED drivers. Therefore, the LED driver apparatus 1000 may secure a stable current and a fast settlement time.

Figure 2:
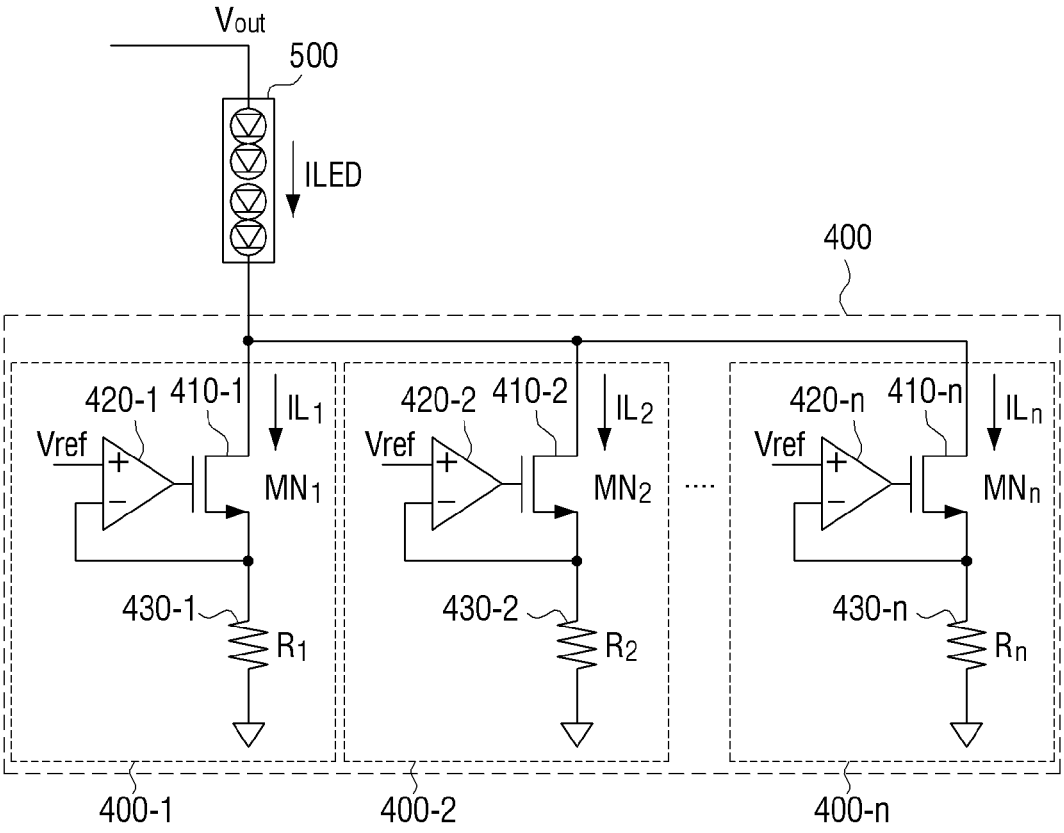
FIG. 2 is a circuit diagram illustrating examples of LED drivers.

FIG. 2 is a circuit diagram illustrating a plurality of LED drivers according to an example of LED driver apparatus 1000.

Referring to FIG. 2, a plurality of LED drivers 400-1, 400-2 . . . **400-*n* are connected to one another in parallel and supply constant currents to the LED array 500. The constant currents supplied from the plurality of LED drivers 400 to the LED array 500 may have the same amplitude or may have different amplitudes. Each of the plurality of LED drivers 400-1, 400-2 . . . 400-*n* includes switching units 410-1, 410-2 . . . 410-*n*, comparators 420-1, 420-2 . . . 420-*n*, and resistors 430-1, 430-2 . . . 430-*n***.

The switching units 410-1, 410-2 . . . **410-*n* respectively perform switching operations according to output signals of the comparators 420-1, 420-2 . . . 420-*n*. For example, the switching units 410-1, 410-2 . . . 410-*n* may be implemented with Field-Effect Transistors (FETs). In an LED driver apparatus in which the switching units 410-1, 410-2 . . . 410-*n* are implemented with FETs, the drains may be connected to an end of the LED array 500, the sources may be respectively connected to the ends of the resistors 430-1, 430-2 . . . 430-*n*, and the gates may be respectively connected to the output nodes of the comparators 420-1, 420-2 . . . 420-*n***.

The FETs may have the same size or different sizes, and may have the same allowable current or may have different allowable currents.

The comparators 420-1, 420-2 . . . **420-*n* compare voltages of common nodes that connect to both the switching units 410-1, 410-2 . . . 410-*n* and the resistors 430-1, 430-2 . . . 430-*n*, with a preset reference voltage $V_{REF}$ in order to control the switching units 410-1, 410-2 . . . 410-*n*. For instance, the comparators 420-1, 420-2 . . . 420-*n* may be implemented with Operational Amplifiers (Op-Amps). In an LED driver apparatus in which the comparators 420-1, 420-2 . . . 420-*n* are implemented with the Op-Amps, the positive terminals may be connected to the reference voltage $V_{REF}$, the negative terminals may be connected to the common nodes between the resistors 430-1, 430-2 . . . 430-*n* and the switching units 410-1, 410-2 . . . 410-*n***, and the output terminals may be connected to the gates of the FETs.

The comparators 420-1, 420-2 . . . **420-*n* receive a dimming signal. For example, the comparators 420-1, 420-2 . . . 420-*n* may receive the dimming signal as an enable signal. In such an LED driver apparatus, when the dimming signal is turned on, the comparators 420-1, 420-2 . . . 420-*n* may respectively control the switching units 410-1, 410-2 . . . 410-*n* to supply constant currents to the LED array 500. Also, when the dimming signal is turned off, the comparators 420-1, 420-2 . . . 420-*n* may respectively control the switching units 410-1, 410-2 . . . 410-*n* to cut off the supply of the constant currents to the LED array 500**.

The resistors 430-1, 430-2 . . . **430-*n* each respectively have an end that is connected to the switching units 410-1, 410-2 . . . 410-*n*, and another end that is grounded. The resistors 430-1, 430-2 . . . 430-*n* may all have the same resistance value or may each have a different resistance value. In an LED driver apparatus in which the resistors 430-1, 430-2 . . . 430-*n* have the different resistance values, the LED drivers 400-1, 400-2 . . . 400*n* may supply constant currents having different amplitudes to the LED array 500**.

Due to the above-described circuit configuration, a plurality of LED drivers 400 supply constant currents having an amplitude $I_{LED}$ to the LED array 500. In this example, the amplitude $I_{LED}$ is a sum of amplitudes of the constant currents of the LED drivers 400, satisfying the equation: $I_{LED}=I_{L1}+I_{L2}+ \ldots +I_{Ln}$. Since each of the constant currents of the LED drivers 400 have an amplitude of $V_{REF}/R$, it follows that the amplitude $I_{LED}$ may be determined with the equation: $I_{LED}=V_{REF}/R_1+V_{REF}/R_2+ \ldots +V_{REF}/R_n$.

In the event that the LED array 500 requires a constant current of 100 mA, and one constant current source is used, an allowable current of a transistor of the one constant current source is 100 mA or more. Therefore, a parasitic capacitance of the corresponding transistor increases.

However, in the event that a plurality of LED drivers is used, the parasitic capacitances of the transistors may be decreased. For example, in the event that four LED drivers are used, the LED array 500 may be driven by using a plurality of transistors each having an allowable current of about 25 mA. Thus, parasitic capacitances of the transistors can be lowered by using a plurality of LED drivers. As a result, the sizes of compensation capacitors that are used to reduce the parasitic capacitances do not need to be increased, thereby securing a fast settlement time.

It is noted that three or more LED drivers 400 are used in the example described in FIG. 2, but an LED driver apparatus may also be realized by using two LED drivers. Also, in the descriptions of FIG. 2, all of the plurality of LED drivers 400 supply constant currents to the LED array 500. However, in other examples, only a portion of the plurality of LED drivers 400 may be driven. For instance, such an example is described with reference to FIG. 3.

Figure 3:
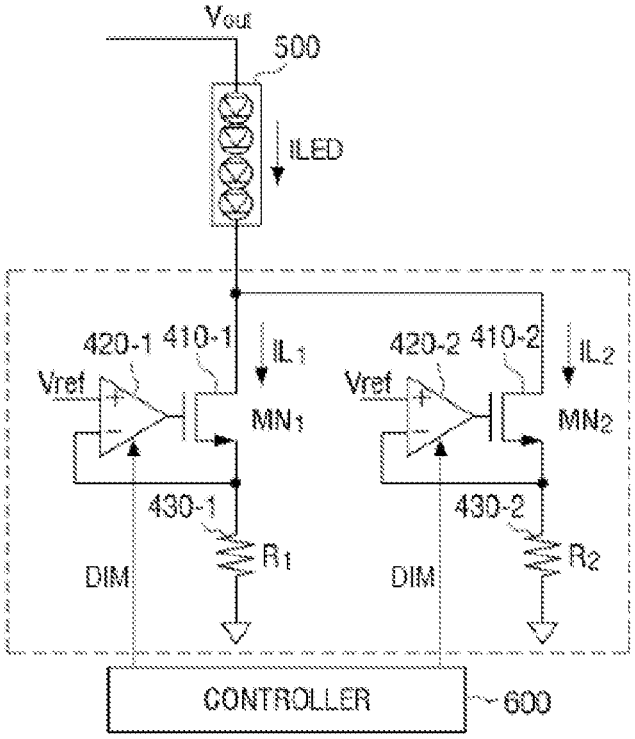
FIG. 3 is a circuit diagram illustrating other examples of LED drivers.
Figure 4:
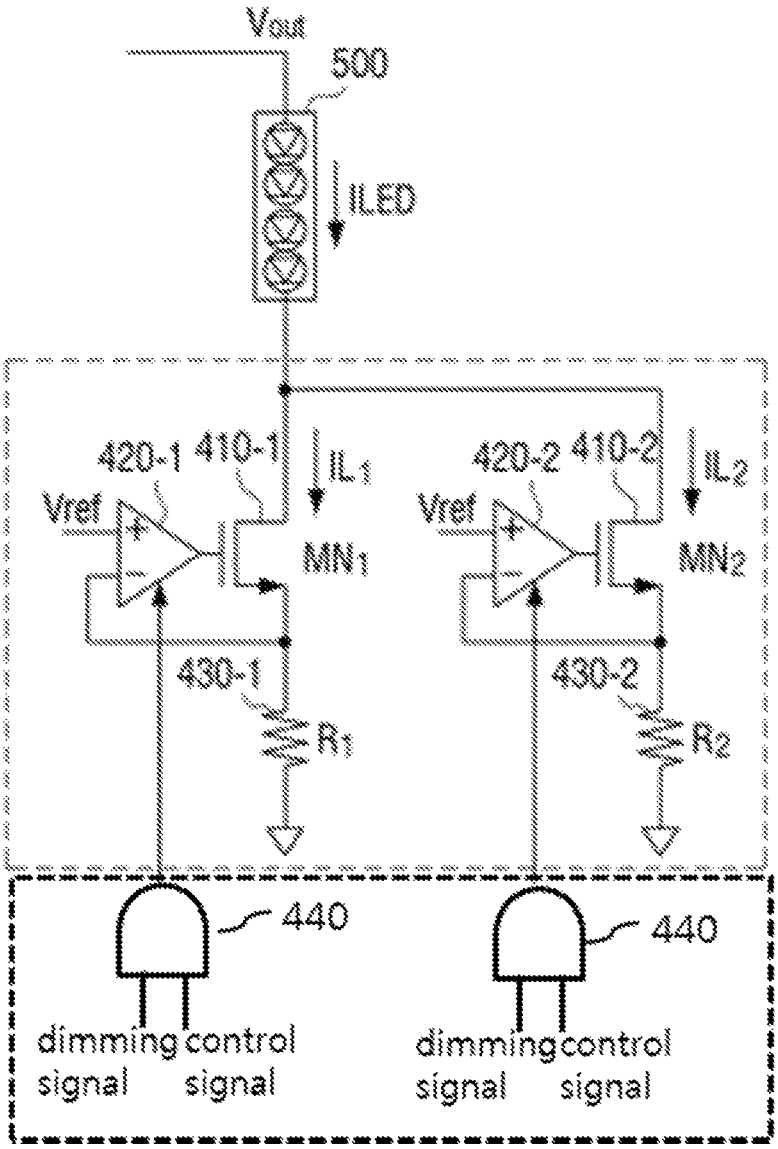
FIG. 4 is a circuit diagram illustrating another example of LED drivers including dimming and control signals being input into an AND logic circuit.

FIG. 3 illustrates a circuit diagram of a plurality of LED drivers according to another example that is within the scope of the present description.

Referring to FIG. 3, the plurality of LED drivers 400 are connected to one another in parallel and each include switching units 410-1 and 410-2, comparators 420-1 and 420-2, and resistors 430-1 and 430-2.

The switching units 410-1 and 410-2 respectively perform switching operations according to output signals of the comparators 420-1 and 420-2. For example, the switching units 410-1 and 410-2 may be implemented with FETs. If the switching units 410-1 and 410-2 are implemented with FETs, the drains may be connected to an end of the LED array 500, the sources may be respectively connected to the ends of the resistors 430-1 and 430-2, and the gates may be connected to the output nodes of the comparators 420-1 and 420-2. In this example, the FETs may have the same size or may have different sizes.

The comparators 420-1 and 420-2 compare voltages of common nodes that commonly connect to both the switching units 410-1 and 410-2 and the resistors 430-1 and 430-2, with a preset reference voltage $V_{REF}$ in order to control the switching units 410-1 and 410-2. For instance, the comparators 420-1 and 420-2 may be implemented with Op-Amps. In an LED driver apparatus in which the comparators 420-1 and 420-2 are implemented with Op-Amps, the positive terminals may be connected to the reference voltage $V_{REF}$, the negative terminals may be connected to the common nodes between the resistors 430-1 and 430-2 and the switching units 410-1 and 410-2, and the output terminals may be respectively connected to gates of the FETs.

The comparators 420-1 and 420-2 respectively receive control signals. For instance, when the comparators 420-1 and 420-2 receive the control signals of the controller 600, the comparators 420-1 and 420-2 may respectively control the switching units 410-1 and 410-2 to supply the constant currents to the LED array 500. In response to the control signals being turned off, the comparators 420-1 and 420-2 may respectively control the switching units 410-1 and 410-2 to cut off the supply of the constant currents to the LED array 500.

One ends of the resistors 430-1 and 430-2 are connected to the switching units 410-1 and 410-2, and the other ends of the resistors 430-1 and 430-2 are grounded. The resistors 430-1 and 430-2 may all have the same resistance value or may each have a different resistance value. In the event that the resistors 430-1 and 430-2 each have a different resistance value, the LED drivers 400-1 and 400-2 may supply constant currents having different amplitudes to the LED array 500.

The controller 600 controls the operation of the plurality of LED drivers 400-1 and 400-2 according to an amplitude of a constant current required for the LED array 500. For instance, the controller 600 may calculate the amplitude of the constant current required for the LED array 500 according to an external control or an internal calculation and control only one of the LED drivers 400-1 and 400-2 appropriate for the calculated amplitude of the constant current to operate. For example, in the event that the two LED drivers 400-1 and 400-2 supply a constant current having a maximum amplitude of 25 mA, and a maxim constant current required for the connected LED array 500 is 50 mA, the controller 600 may control both the two LED drivers 400-1 and 400-2 to operate. Also, provided that the maximum amplitude of the constant current required for the LED array 500 is 25 mA, the controller 600 may control only the one LED driver 400-1 to operate.

The controller 600 receives a dimming signal, generates the control signals according to the dimming signal, and respectively supplies the control signals to the comparators 420-1 and 420-2. In the present example, the controller 600 receives the input dimming signal and provides the control signals generated according to the dimming signal to the comparators 420-1 and 420-2. However, the dimming signal and the control signals may be input into an additional AND logic circuit 440, and an output of the AND logic circuit 440 may be provided as an enable signal of a comparator.

In the examples illustrated in FIGS. 1 through 3, a constant current is supplied to only one LED array. However, in other examples, the LED driver apparatus may supply a plurality of constant currents to a plurality of LED arrays, respectively, by using a plurality of LED drivers.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A Light Emitting Diode (LED) driver apparatus, comprising:

a DC-DC converter supplying a driving voltage to an LED array;

two or more LED drivers comprising corresponding resistances driving the LED array responsive to a dimming signal, each LED driver comprising a switching unit and a grounded corresponding resistance, each switching unit being directly connected to another LED driver in parallel through a shared node, and each LED driver being configured to supply a corresponding constant current to the LED array dependent on the dimming signal and the corresponding resistance; and a controller providing respective enable signals, each generated by an AND logic circuit based on the dimming signal and a corresponding control signal, to the two or more LED drivers to selectively operate each of the two or more LED drivers, wherein the LED drivers provide a sum of the corresponding constant currents to the LED array through the shared node, and wherein two or more of the corresponding resistances are different.

2. The LED driver apparatus of claim 1, further comprising:

an input unit configured to receive the dimming signal from an external device.

3. The LED driver apparatus of claim 2, further comprising:

a Pulse Width Modulation (PWM) signal generator configured to receive the dimming signal and generate a PWM signal, wherein the DC-DC converter is configured to provide a forward bias voltage to the LED array based on the generated PWM signal to control when the LED array operates in a saturation range.

4. The LED driver apparatus of claim 1, wherein the plurality of LED drivers include at least two LED drivers configured to supply corresponding constant currents having a same amplitude to the LED array.

5. The LED driver apparatus of claim 1, wherein each of the plurality of LED drivers comprises:

a resistor, as the grounded corresponding resistance, having a first end that is grounded;

the switching unit configured to selectively connect an end of the LED array to a second end of the resistor; and a comparator configured to compare a preset reference voltage with a voltage of a common node that connects to both the switching unit and the resistor, wherein the switching unit is configured to selectively connect an end of the LED array to the second end of the resistor.

6. The LED driver apparatus of claim 5, wherein the switching unit is a Field-Effect Transistor (FET) comprising a drain connected to an end of the LED array, a source connected to the common node, and a gate connected to an output node of the comparator.

7. The LED driver apparatus of claim 6, wherein the comparator is an Operational Amplifier (Op-Amp) configured to receive the reference voltage through a positive terminal, receive the voltage of the common node through a negative terminal, and output a difference between the reference voltage and the voltage of the common node to the gate of the FET, wherein the comparator is configured to operate based on the dimming signal.

8. The LED driver apparatus of claim 5, further comprising:

the controller configured to control an operation of the plurality of LED drivers based on an amplitude of a constant current required for the LED array.

9. The LED driver apparatus of claim 1, wherein the LED array is driven under a constant current having an amplitude between 50 mA and 150 mA.

10. A Liquid Crystal Display (LCD) comprising:

a liquid crystal panel; and a backlight unit comprising an LED driver apparatus of claim 1.

11. The LED driver apparatus of claim 1, wherein the shared node is directly connected to a drain of each of the plurality of switching units.

12. The LED driver apparatus of claim 1, further comprising:

the controller configured to distribute a current flowing through an LED array among two or more LED drivers.

13. A method of driving an LED array, the method comprising:

supplying a driving voltage to an LED array, by using two or more LED drivers comprising corresponding resistances driving the LED array responsive to a dimming signal, each LED driver comprising a switching unit and a grounded corresponding resistance, each switching unit being directly connected to another LED driver in parallel through a shared node, each LED driver being configured to supply a corresponding constant current to the LED array dependent on the dimming signal and the corresponding resistance;

receiving, at the two or more LED drivers, the dimming signal from an external device; and providing, using a controller, respective enable signals, each generated by an AND logic circuit based on the dimming signal and a corresponding control signal, to the two or more LED drivers to selectively operate each of the two or more LED drivers, wherein the LED drivers provide a sum of the corresponding constant currents to the LED array through the shared node, and wherein two or more of the corresponding resistances are different.

14. The method of claim 13, further comprising:

generating a Pulse Width Modulation (PWM) signal based on the dimming signal; and supplying the PWM signal to a DC-DC converter that is configured to provide a forward bias voltage to the LED array.

15. The method of claim 14, further comprising:

controlling an operation of the plurality of LED drivers based on an amplitude of a current required for the LED array as determined according to an external control or an internal calculation.

16. The method of claim 14, wherein each of the plurality of LED drivers further comprises:

a resistor, as the grounded corresponding resistance, having a first end that is grounded;

the switching unit configured to selectively connect an end of the LED array to a second end of the resistor; and a comparator configured to compare a preset reference voltage with a voltage of a common node that connects to both the switching unit and the resistor, wherein the switching unit is configured to selectively connect an end of the LED array to the second end of the resistor.

17. The method of claim 13, further comprising:

supplying, from the plurality of LED drivers that include at least two LED drivers, corresponding constant currents having a same amplitude to the LED array.

18. The method of claim 13, further comprising:

providing a control signal to a comparator of a LED Driver; and distributing a current flowing through an LED array among two or more LED drivers based on the control signal.

* * * * *